United States Patent [19]

Huin et al.

[11] Patent Number: 5,035,280

[45] Date of Patent: Jul. 30, 1991

[54] PROCESS AND APPARATUS FOR THE CONTINUOUS CASTING OF FINE METAL WIRE

[75] Inventors: Didier Huin, Nancy; Paul-Victor Riboud, Metz, both of France

[73] Assignee: Institut De Recherches De La Siderurgie Francaise, Puteaux, France

[21] Appl. No.: 455,063

[22] Filed: Dec. 22, 1989

[30] Foreign Application Priority Data

Dec. 22, 1988 [FR] France ..... 88 17366

[51] Int. Cl.[5] ..... B22D 11/06

[52] U.S. Cl. ..... 164/463; 164/423; 164/444

[58] Field of Search ..... 164/463, 423, 429, 479, 164/486, 444

[56] References Cited

U.S. PATENT DOCUMENTS 3,960,200 6/1976 Kavesh .

FOREIGN PATENT DOCUMENTS 0039169 4/1981 European Pat. Off. .
57-156863 9/1982 Japan ..... 164/463
61-119354 6/1986 Japan ..... 164/463

OTHER PUBLICATIONS

"Production of Fine Metallic Wire"—Jun. 1986.
"Production of Metallic Strip"—vol. 6, No. 134, Jul. 21, 1982.

*Primary Examiner*—Kuang Y. Lin
*Attorney, Agent, or Firm*—Pollock, Vande Sande & Priddy

[57] ABSTRACT

Process for the continuous casting of a fine metal wire, in which a jet of liquid metal is quenched and solidified in a layer of cooling liquid deposited on a surface in motion. The dispersal of the turbulence of the cooling liquid is accelerated upstream of the point of impact of the jet of metal on the liquid. The apparatus for carrying out the process comprises a grating arranged across the layer of cooling liquid between the outlet of the pipe feeding the cooling liquid onto the surface in motion and the point of penetration of the jet of metal into the cooling liquid.

6 Claims, 1 Drawing Sheet

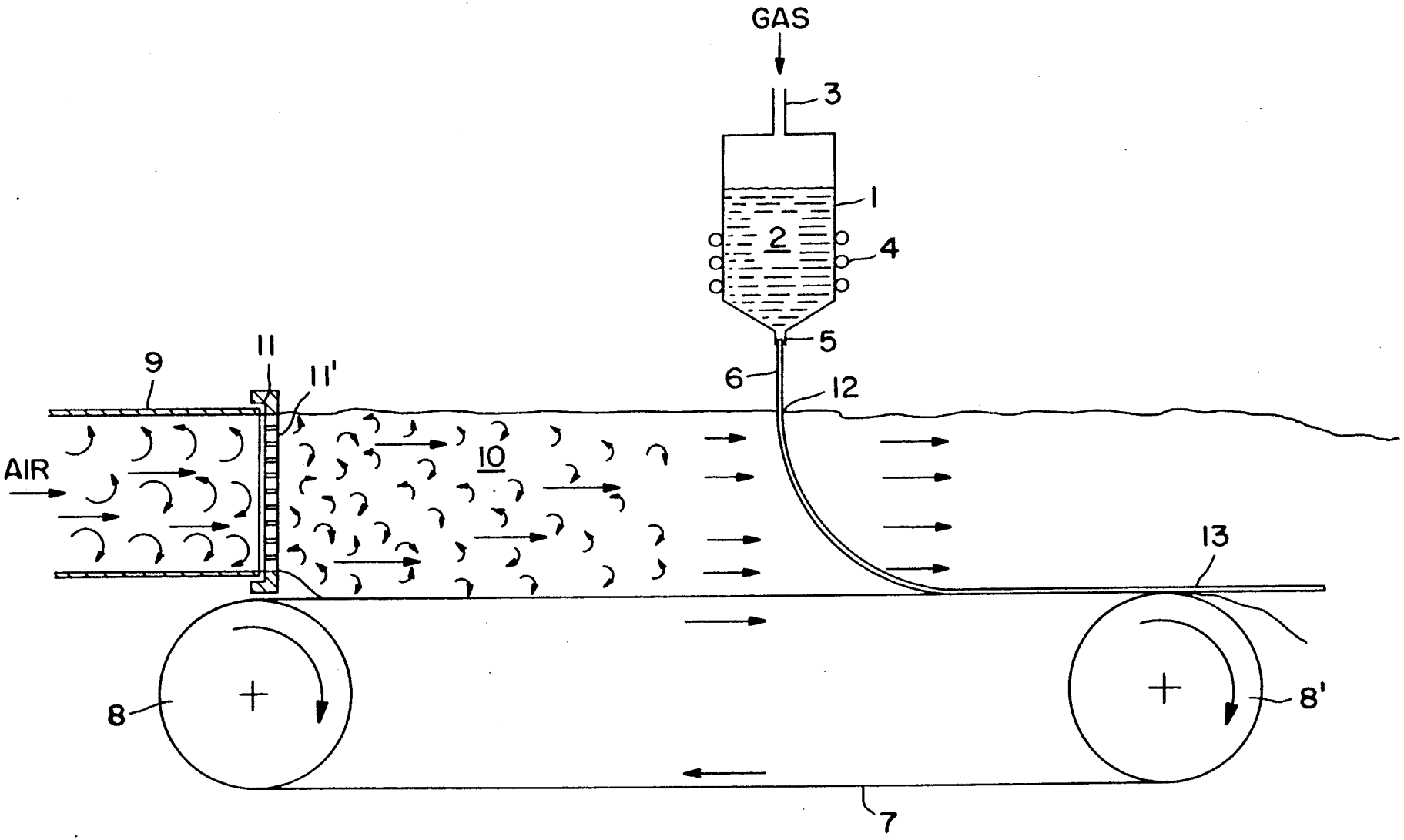
GAS
3
1
4
2
5
6
12
13
8'
7
10
11'
11
9
AIR
8

PROCESS AND APPARATUS FOR THE CONTINUOUS CASTING OF FINE METAL WIRE

FIELD OF THE INVENTION

The present invention relates to the sector of the direct casting of wires of small thickness from liquid metal.

PRIOR ART

In recent years there has been the development of a casting process making it possible to obtain directly from liquid metal, metal filaments of indeterminate length, of substantially circular cross-section and of very small diameter, as small as approximately 80 μm. This process, described particularly in European Patent EP 0,039,169, involves forming a jet of metal from a vessel of liquid metal equipped with heating means and with an outlet nozzle, the diameter of the vessel being equal to or slightly larger than the diameter of the desired filament. This jet of metal subsequently penetrates into a layer of cooling liquid, such as water or an aqueous solution of a salt, e.g., sodium chloride, magnesium chloride or zinc chloride, ensuring that the metal wire solidifies. This layer of liquid is in motion in a transverse direction relative to that of the jet of metal. It flows onto a solid surface which is itself in motion and which can consist of the interior of a rotating drum (European Patent EP 0,039,169 already mentioned) or of a horizontal or concave portion of a traveling grooved belt forming a loop (European Patent EP 0,089,134).

The wire, as it is being cast, is wound inside the drum under the effect of centrifugal force or is coiled on the outside of the casting machine.

This process, because of the high cooling rate which it affords, makes it possible, if the metal is amorphizable, to obtain amorphous wires of uniform dimension which have, among other properties, very high tensile strength. It is thus possible to cast amorphous wires composed of alloys based on various metals, such as iron, copper, cobalt, gold, aluminum, etc.

It is known (from EP 0.089,134) that, to obtain a continuous wire and a sufficiently rapid cooling of the jet of metal for this purpose, it is preferable if the cooling liquid circulates at a speed higher than or equal to that of the jet. Since the latter is often of the order of 5 to 15 m/s, this implies that the cooling liquid is in a turbulent flow state at the moment when it reaches the surface in motion.

Now, one of the conditions necessary for obtaining a continuous wire of uniform diameter is that the flow state of the cooling liquid at its contact with the jet of metal should be as close as possible to a laminar flow. Otherwise, the jet of metal risks being broken up before it solidifies. Fibers of small length would therefore be obtained instead of a continuous wire. Consequently, the jet of metal must be introduced into the liquid at a point sufficiently distant from the outlet of the feed pipe to ensure that turbulence of the liquid has had time to disperse to a very great extent before this point is reached.

This implies either building a large-scale installation or imparting only a relatively low speed to the cooling liquid. But under these conditions, if the speed of the jet of metal remains high, the jet is cooled less energetically and, on the other hand, there is the risk that it will be impossible to obtain a continuous wire. In contrast, if it is decided to subject the jet of metal also to a relatively low speed, the productivity of the installation will be impaired thereby.

SUMMARY OF THE INVENTION

An object of the present invention is to provide a method for accelerating the dispersal of the turbulence of the cooling liquid. It makes it possible to build installations of smaller size which are capable of producing amorphous wires of high quality reliably and on a large scale.

To this end, an object of the invention is a process for the continuous casting of a fine metal wire, in which a jet of liquid metal is quenched and solidified in a layer of cooling liquid deposited on a surface in motion, wherein the dispersal of the turbulence of the cooling liquid is accelerated upstream of the point of impact of the jet of metal on the said liquid.

Another object of the invention is an apparatus for the continuous casting of fine metal wire, comprising a vessel equipped with a nozzle, through which a jet of liquid metal flows off, the said vessel being located above a surface in motion, on which is deposited, by means of a feed pipe, a layer of cooling liquid in which the said jet of metal is quenched and solidified, wherein, in order to accelerate the dispersal of the turbulence of the cooling liquid, the apparatus also comprises a fine-mesh grating arranged across the layer of cooling liquid between the outlet of the said feed pipe and the point of penetration of the jet of metal into the layer of cooling liquid.

This grating is preferably placed at the end of the feed pipe.

It will be understood that the function of this grating is to "chop" the flow of the liquid so as to reduce the size of the turbulences, thereby making it easier for them to disperse quickly.

This grating is placed in the path of the cooling liquid between its exit from the pipe and the point at which the jet of metal penetrates into it. The eddies within the cooling liquid have a certain characteristic size before they pass through the grating. If this characteristic size is larger than the mesh of the grating, the passage through the latter breaks up the eddies into smaller eddies, the size of which is in the order of the mesh size of the grating. Now, the smaller the size of the eddies, the more quickly the turbulence of a flow decreases. Giving these eddies a small size by means of the grating as soon as possible (preferably at their exit from the pipe) therefore makes it possible to bring forward the change from a turbulent flow state of the cooling liquid to a laminar flow state. In general terms, the finer the mesh of the grating, the more quickly the turbulence decreases.

BRIEF DESCRIPTION OF THE DRAWING

The accompanying single FIGURE shows diagrammatically, in longitudinal section, an installation for the direct casting of wire, equipped with an apparatus according to the invention.

DESCRIPTION OF THE PREFERRED EMBODIMENT

This installation is supplied by a vessel 1 containing the casting metal 2 in the liquid state. This vessel 1 is equipped with means 3 for blowing in an inert gas, ensuring, on the one hand, the protection of the metal 2 against contamination by the atmosphere and, on the other hand, pressurizing of the vessel which contributes to regulating the flow rate of the metal. It also comprises means 4 for heating the liquid metal and a nozzle 5, through which the metal flows off, at the same time forming a jet 6. The diameter of this nozzle is equal to or slightly larger than that of the wire to be cast. The nozzle 5 is arranged above a conveyor belt 7 which is equipped with a groove (not shown) and the travel of which is obtained by means symbolized by the rotating pulleys 8 and 8'. The pipe 9 feeds a cooling liquid 10 into the groove of the belt 7. The grating 11 according to the invention, which has meshes 11', is fastened to the end of this pipe 9. A rectilinear form is imparted to the belt 7 between the end of the pipe 9 and a point located beyond the vertical alignment with the vessel 1. The jet of metal penetrates into the layer of cooling liquid at the point 12 located in vertical alignment with the nozzle 5. Under the action of the liquid and its motion, it solidifies in the form of a continuous wire 13 and assumes a curved shape before coming into contact with the belt 7. The installation also comprises means (not shown) for capturing and coiling the wire after the latter has left the belt 7.

In the drawing, the change of the turbulence within the liquid is symbolized by arrows indicating qualitatively the number and size of the eddies. Inside the pipe, these eddies are numerous and of high amplitude. After the liquid has come out of the pipe and after it has passed through the grating, these eddies are broken up into eddies of low amplitude (of the order of the size of the meshes of the grating). The number and amplitude of these eddies decrease in proportion as the liquid advances. If the rectilinear portion of the belt 7 is sufficiently long, the turbulence has time to disperse, and the cooling liquid resumes a laminar flow state symbolized by the arrows parallel to the direction of travel of the belt 7. The quenching of the jet of metal 6 to form the continuous wire 13 is preferably carried out in this zone of laminar flow.

As just seen, the grating can be located at the end of the feed pipe, thus making it possible to reduce the turbulence as soon as possible. However, if such a solution is adopted, it is of course essential that the cooling liquid does not thereafter experience appreciable disturbances in its flow, before it comes into contact with the jet of metal. Such disturbances could be caused by sudden changes in the direction of the flow, for example in the zone where the liquid comes into contact with the solid surface in motion. In practice, this arrangement of the grating is preferable only if, at the moment of this contact, the direction of flow of the liquid set by the orientation of the pipe and the direction of travel of the solid surface are substantially parallel.

In order to obtain a significant reduction in the size of the eddies, the size of the meshes of the grating is preferably less than 1/10th of the diameter of the feed pipe or, more generally, less than 1/10th of the thickness of the liquid layer. On the other hand, the passage cross-section of the liquid through the grating must be sufficient to prevent losses of head in the flow of the liquid. Typically, the meshes have a size of between 0.5 and 10 mm.

Fitting such a grating on an existing installation therefore affords the following advantages:

if the operating conditions are not otherwise modified, the decrease of the turbulence within the cooling liquid allows the solidification of the jet of metal to, take place in a more reliable way;

it is also possible to preserve the same turbulence as in the absence of a grating, by increasing the speed of movement of the liquid. Moreover, if the speed of the jet of metal is unchanged, its solidification is accelerated and the degree of amorphization of the structure of the wire can be increased thereby. If the speed of the jet of metal is increased in the same proportions as the speed of the liquid, the productivity of the installation is improved.

Another option involves not changing the other operating conditions, but bringing the point where the jet of metal is introduced into the liquid nearer to the point at which the cooling liquid reaches the surface in motion. Thus, without altering the quality of the wire and the productivity of the installation, the overall bulk of the latter can be reduced considerably.

As an example, in an installation which would be equipped with a cooling-liquid feed pipe of a diameter of 10 mm and where the liquid would move at a speed of 15 m/s, its flow state becomes virtually laminar after a distance of 10 m. Arranging a grating of a mesh size of 1 mm at the outlet of the feed pipe makes it possible to reduce this distance to approximately 1 m.

The grating is not necessarily fastened to the cooling-liquid feed pipe. The essential factor is that it be located in the path of the liquid at a point sufficiently distant from the point of penetration of the jet of metal to ensure that, at this latter point, the turbulence of the liquid is thereby decreased significantly.

Likewise, the invention can be used in wire-casting installations where the surface in motion vertically in alignment with the vessel of liquid metal has a curvature the concavity of which is oriented toward the said vessel. This type of installation includes particularly those consisting of a rotating drum, the inner surface of which carries the cooling liquid.

We claim:

1. In a process for continuous casting of fine metal wire, said process comprising the steps of (a) melting a metal in a vessel;

(b) casting said metal out of said vessel by forming a jet of liquid metal; and (c) quenching and solidifying said jet in a layer of cooling liquid deposited on a surface in motion;

the improvement consisting of:

(d) accelerating the dispersal of the turbulence of said layer of said cooling liquid upstream of a point of impact of said jet on said layer of said cooling liquid, by breaking up eddies within said layer of said casting liquid into eddies of low amplitude.

2. Apparatus for continuous casting of fine metal wire, comprising (a) a vessel (1) containing a liquid metal (2) equipped with a nozzle (5) through which a jet (6) of said liquid metal (2) flows off;

(b) a surface in motion, located underneath said nozzle (5);

(c) a feed pipe (9) depositing on said surface a layer (10) of cooling liquid on which said jet (6) of said liquid metal (2) is quenched and solidified; and (d) a grating (11) arranged across said layer (10) of cooling liquid between an outlet of said feed pipe (9) and a point (12) of penetration of said jet (6) of liquid metal into said layer (10) of cooling liquid.

3. The apparatus as claimed in claim 2, wherein said grating is placed at the end of said feed pipe.

4. The apparatus as claimed in claim 2, wherein said grating has meshes no greater than 1/10th of the thickness of the layer of cooling liquid.

5. The apparatus as claimed in claim 4, wherein said meshes of said grating have a size of between 0.5 and 10 mm.

6. Apparatus as claimed in claim 2, wherein, in a zone located under said nozzle (5) of said vessel (1) of liquid metal (2) and comprising said point (12) of penetration of said jet (6) into said layer (10) of cooling liquid, said surface in motion travels in one plane.

* * * * *